US006092963A

United States Patent [19]

Miya et al.

[11] Patent Number: 6,092,963

[45] Date of Patent: Jul. 25, 2000

[54] TAIL STRUCTURE OF SHIELD DRIVING MACHINE

[75] Inventors: Kiyoshi Miya; Yoshihiro Tanaka, both of Tokyo, Japan

[73] Assignee: Obayashi Corporation, Osaka, Japan

[21] Appl. No.: 09/184,984

[22] Filed: Nov. 3, 1998

[30] Foreign Application Priority Data

Nov. 18, 1997 [JP] Japan ..... 9-316853
Dec. 26, 1997 [JP] Japan ..... 9-360568

[51] Int. Cl.[7] ..... E21D 9/06

[52] U.S. Cl. ..... 405/147; 405/138; 405/141

[58] Field of Search ..... 405/147, 141, 405/138, 146, 142, 150.1, 151

[56] References Cited

U.S. PATENT DOCUMENTS

| | | | |
|---|---|---|---|
| 748,809 | 1/1904 | Stone | 405/147 X |
| 1,296,312 | 3/1919 | O'Rourke | 405/147 |
| 3,410,098 | 11/1968 | Winberg | 405/147 X |
| 4,003,211 | 1/1977 | Klapdor et al. | 405/147 X |
| 4,990,027 | 2/1991 | Hattori et al. | 405/147 X |

*Primary Examiner*—Dennis L. Taylor
*Attorney, Agent, or Firm*—Nixon Peabody LLP; Thomas W. Cole

[57] ABSTRACT

The present invention relates to a tail structure of a shield driving machine, and in particular relates to an improvement technique of the tail sealing portion of this type of shield driving machine, in order to eliminate wearing of the tail seal. The tail structure has a first tail seal 12 and a second tail seal 14. The first tail seal 12 is provided with a tail ring 12*a*, a seal tube 12*b* and packing 12*c*, and the tail ring 12*a* is secured movably in the axial direction of a skin plate 10. The packing 12*c* is pressure-fitted to segments 11 in line with enlargement of the seal tube 12*b* and is spaced from the segments 11 in line with reduction of the seal tube 12*b*. The second tail seal 14 is provided with a seal tube 14*a* and packing 14*b*, wherein the packing 14*b* is pressure-fitted to the segments 11 in line with enlargement of the seal tube 14*a* and is spaced from the segments 11 in line with reduction of the seal tube 14*b*. When excavating, the packing 14*b* causes the first tail seal 12 to be pressure-fitted to the segments 11 without moving the first tail seal 12, and causes the second tail seal 14 to be spaced from the segments 11.

7 Claims, 5 Drawing Sheets

TAIL STRUCTURE OF SHIELD DRIVING MACHINE

BACKGROUND OF THE INVENTION

1. Technical Field of the Invention

The present invention relates to a tail structure of a shield driving machine, and in particular relates to an improvement technique of the tail sealing portion of this type of shield driving machine.

2. Description of Prior Arts

In a shield construction applied to building of a subway tunnel in a city zone, recently, reduction of the construction costs and shortening of the construction term are of importance. In order to meet these requests, it is attempted that the excavation distance per shield driving machine is lengthened.

Furthermore, in shaft building work in a shield construction, since it becomes very difficult to secure a site in line with recent overcrowding of a city zone, and the installation level of a shield tunnel is even deepening, the costs and term required for building a shaft has been increased, wherein lengthening of the excavation distance of a shield driving machine is further accelerated.

Although various problems arise in line with a lengthening of the excavation distance of a shield driving machine, the durability of the tail seal portion of a shield driving machine is an important theme. The tail seal portion which prevents peripheral water, earth and sand, and back-filling materials from flowing into the shield driving machine body is usually constructed as shown in FIG. 13.

The tail seal portion "a" illustrated in the drawing prevented peripheral water, etc., from flowing into the machine body by providing a plurality of flutes of tail brush "d", which is slidably brought into contact with the outer circumferential surface of segments "c", on the inner circumferential surface of a skin plate "b" at the tail side, and by filling a semi-solid filling material "e" such as grease between the tail brushes "d".

However, with such a conventional structure of the tail seal portion "a", especially, in line with a lengthening of the excavation distance of a shield driving machine, there were technical problems as described below;

That is, at the tail seal portion "a" illustrated in FIG. 13, since the tail brushes "d" are brought into contact with segments "c" while the shield driving machine is excavating, they slidably move in line with the excavation. Therefore, the tail brushes "d" are worn by frictions with the segments "c", whereby peripheral water invades the tail portion of the shield driving machine while driving a long distance.

Furthermore, a back-filling material invades the tail brushes "d" and is adhered thereto gradually, wherein the adhered back-filling material is solidified. The resiliency of the tail brushes "d" is gradually spoiled, and it becomes difficult to follow a change of the clearance between the skin plate "b" and segments "c", wherein when driving and excavating a long distance, peripheral water, etc., invades the tail portion of the shield driving machine.

However, construction of tunnels by a shield driving machine is not limited to construction of tunnels for subways and roads for transport facilities. For example, the inventors disclosed utilization of the present invention in construction of water-intake tunnels to intake sea water for a plant producing fresh water by using sea water in Japanese Patent Application No. 218492 of 1997.

That is, in order to secure drinking water on islands where it scarcely rains or in desert areas, a plant producing fresh water is installed in the vicinity of a sea shore. Furthermore, sea water is prime water for treatment in salt production plants, wherein in these types of sea water treatment facilities, it is necessary to introduce sea water into a plant producing fresh water.

Therefore, in such a sea water treatment facility, conventionally, sea water was introduced through a water-intake tunnel in which vinyl chloride tube covered with unwoven cloth, having a number of penetrated water-intake pores formed thereon, and porous Hume pipes are laid, However, since a water-intake tunnel of such construction is buried by an excavation construction method or a sinking and laying method, the site on the ground right above the laying position and/or its surrounding are exclusively occupied for the sinking and laying work. Therefore, from this viewpoint, there are various limitations in the construction work resulting therefrom.

Therefore, the inventors developed a technique for building these types of water-intake tunnels by a shield driving method. Segments used to build such water-intake tunnels are, as shown in FIG. 14, such that a permeable member 2 is attached to the outside of a body plate 1 such as steel segments and ductile segments conventionally used for a usual shield construction method.

The permeable member 2 is made of porous concrete, etc., and is so constructed that underground water passing through the permeable member 2 is positively taken into the inside through water-intake openings (not illustrated) which are openable and closable, and secured at the body plate 1.

However, when building a water-intake tunnel by a shield driving machine, using such water-intake segments 3, particularly, there were such technical problems as described below as regards the tail portion of a shield driving machine.

That is, as described above, the tail structure of a shield driving machine used for a usual shield construction method, plural flutes of tail brushes "d" which are slidably brought into contact with the outer circumferential surface of segments "c" were disposed on the inner circumferential surface of the skin plate "b" at the tail side, and a filling material "e" was filled in between the tail brushes "d", wherein peripheral water was prevented from invading inside.

However, if the tail structure of such a construction is applied to the abovementioned water-intake segments 3, it is impossible to cover the entirety of the permeable member 2 even in a case where, as shown in FIG. 14, the tail brushes "d" are slidably brought into contact with the outer circumferential surface of the water-intake segments 3. Therefore, peripheral water invades in a channel indicated by the arrow depicted by a solid line, and the tail structure does not function as a tail seal.

Furthermore, if a filling material "e" is filled in between the tail brushes "d" even though the entirety of the permeable portion 2 can be covered by the tail brushes "d", grease clogs pores of the permeable member 2 and reduces the permeability of the permeable member 2. Therefore, the filling material "e" can not be used. Unless the filling material "e" is used, peripheral water invades through the clearance of the tail brushes "d", wherein the tail brushes "d" can not function as a tale seal.

SUMMARY OF THE INVENTION

The present invention was developed in order to solve the abovementioned problems, and it is therefore the first object of the invention to provide a tail structure of a shield driving machine, by which the durability thereof can be improved by getting rid of the friction at the tail seal portion.

Furthermore, it is the second object of the invention to provide a tail structure of a shield driving machine, which is able to prevent peripheral water from invading in a case where a water-intake tunnel is built by using water-intake segments.

In order to achieve the abovementioned objects, the invention is characterized in that, in a shield driving machine provided with a tail sealing portion which intervenes between the outer circumferential surface of segments installed on the excavation wall surface and the inner circumferential surface of a skin plate at the tail side and prevents peripheral water, earth and sand, and back-filling material from flowing into the skin plate; the tail sealing portion is a first tail seal and a second tail seal which are disposed in the axial direction of the abovementioned skin plate; the first and second tail seals are constructed so that they are able to be pressure-fitted to the abovementioned segments and spaced therefrom; the first tail seal is secured movably in the axial direction of the abovementioned skin plate, and concurrently, the abovementioned second tail seal is fixed at the abovementioned skin plate; any one of the abovementioned first and second tail seals is pressure-fitted to the abovementioned segments when the abovementioned shield driving machine stops excavation; and when the abovementioned shield driving machine is excavating, the abovementioned first tail seal is pressure-fitted to the abovementioned segments without being moved, and concurrently the abovementioned second tail seal is spaced from the abovementioned segments.

According to the tail structure of a shield driving machine constructed as described above, since either one of the first tail seal and the second tail seal is always pressure-fitted to segments when the shield driving machine is excavating or the segments are assembled, it is possible to prevent peripheral water, earth and sand, back-filling materials, etc., from invading.

Furthermore, since, when the shield driving machine is excavating, the first tail seal is pressure-fitted to the segments without being moved and the second tail seal is spaced from the segments, the first and second tail seals are not moved while being slidably brought into contact with the segments, no friction is produced between the respective tail seals and the segments, the durability of the tail seals is further improved, even in a long distance excavation, and the number of times of replacement of the tail seals is reduced.

A tail structure of a shield driving machine; wherein the abovementioned first tail seal is disposed frontward of the abovementioned second tail seal in the direction of excavation; and a tail ring movably disposed along the axial direction of the abovementioned skin plate; is provided with a seal tube secured and fixed at the abovementioned tail ring, the diameter of which is enlargeable and reduceable; and packing which is pressure-fitted to the abovementioned segments in line with enlargement of the abovementioned seal tube and is spaced from the abovementioned segments in line with reduction of the abovementioned seal tube.

According to the construction, since the first tail seal is disposed frontward of the second tail seal in the direction of excavation and the tail ring is made movable, it is possible to easily replace the seal tube and packing of the first tail seal by drawing out the tail ring to the shield driving machine side.

Furthermore, in order to achieve the abovementioned object, the invention is characterized in that, in a shield driving machine used for building a water-intake tunnel, which intervenes between the outer circumferential surface of water-intake segments secured on the excavation wall surface and the inner circumferential surface of a skin plate at the tail side and prevents inflow of peripheral water into the abovementioned skin plate; the abovementioned tail structure is provided with a first tail seal and a second tail seal, which are disposed along the axial direction of the abovementioned skin plate, either one of the abovementioned first or second tail seals is always pressure-fitted to a non-permeable portion of the abovementioned water-intake segments when the abovementioned shield driving machine is excavating or the abovementioned water-intake segments are assembled.

According to the tail structure of a shield driving machine construction as described above, since, when the shield driving machine is excavating or water-intake segments are assembled, either one of the first tail seal or second tail seal is always pressure-fitted to the non-permeable portion of water-intake segments, it is possible to prevent peripheral water from invading.

The abovementioned first tail seal is secured movably along the axial direction of the abovementioned skin plate; the abovementioned first and second tail seals are constructed so that they are able to be pressure-fitted to the abovementioned non-permeable portion and spaced therefrom; and when the abovementioned shield driving machine is excavating, the abovementioned first tail seal is pressure-fitted to the abovementioned non-permeable portion without being moved, and the abovementioned second tail seal is spaced from the non-permeable portion.

According to the construction, since, when the shield driving machine is excavating, the first tail seal is pressure-fitted to the non-permeable portion in a state where the first tail seal does not move, and concurrently, since the second tail seal is spaced from the non-permeable portion, the first and second tail seals do not move while sliding on the water-intake segments, in line with excavation of the shield driving machine, and no friction is produced between the respective tail seals and segments. Therefore, the durability of the tail seals is further improved, and it is possible to attempt to reduce the number of times of replacement of the tail seals in a long distance excavation.

The abovementioned first tail seal is constructed so as to be provided with a tail ring disposed movably along the axial direction of the abovementioned skin plate; a seal tube secured and fixed at the abovementioned tail ring, the diameter of which is enlargeable and reduceable; and packing which is pressure-fitted to the abovementioned non-permeable portion in line with enlargement of the abovementioned seal tube and is spaced from the abovementioned non-permeable portion in line with reduction of the abovementioned seal tube.

According to the construction, since the tail rings are made movable, it is possible to easily replace the seal tubes and packing of the first tail seal by drawing out the tail rings toward the shield driving machine side.

The abovementioned water-intake segments are assembled to be annular at the tail portion side of the abovementioned shield driving machine.

Furthermore, the water-intake segment is constructed of a non-permeable body plate on which openable and closable water-intake pores are provided, and a permeable member integrated with the outside of the abovementioned body plate.

As described in detail in the preferred embodiments, according to the tail structure of a shield driving machine, since it is possible to improve the durability while securely preventing peripheral water, etc., from invading, it is possible to lengthen the excavation length of a shield driving machine.

Furthermore, by the tail structure of a shield driving machine according to the invention, in a case where a water-intake tunnel is built, using water-intake segments, it is possible to prevent peripheral water, etc., from invading.

DETAILED DESCRIPTION OF THE PREFERRED EMBODIMENTS

Hereinafter, a detailed description is given of a preferred embodiment of the invention with reference to the accompanying drawings. FIG. 1 through FIG. 6 shows one preferred embodiment of a tail structure of a shield driving machine according to the invention.

Figure 1:
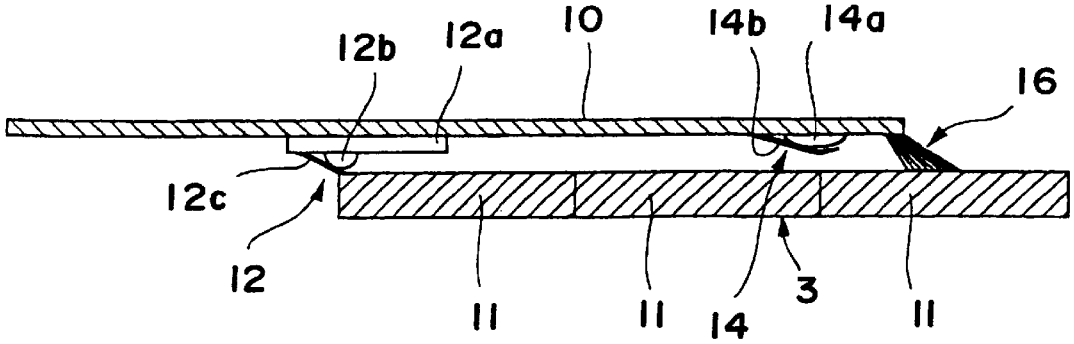
FIG. 1 is a sectional view showing a state before excavation is commenced, in compliance with a preferred embodiment of a tail structure of a shield driving machine according to the invention.

FIG. 1 is a sectional view of the tail portion of a shield driving machine, a skin plate 10 illustrated in the drawing is formed to be cylindrical in the shield driving machine, and reference number 11 is segments.

The segments 11 are generally used for shield construction. The segments 11 are assembled to be annular one after another at the tail portion side in line with advance of excavation of a shield driving machine, wherein steel segments and ductile segments are used as segments 11.

A filling opening (not illustrated) of a back-filling material, which is closed by a cover body during construction and is opened after a tunnel is constructed, is secured at the respective segments 11.

In the structure illustrated in FIG. 1, the first tail seal 12 and the second tail seals 14 are secured along the axial direction of a skin plate 10 of the shield driving machine, and the third tail seal 16 is provided at the rear end of the skin plate 10.

The first tail seal 12 consists of an annular tail ring 12*a* along the inner circumferential surface of the skin plate 10 at the tail side, a seal tube 12*b* secured and fixed on the inner side of the tail ring 12*a*, and packing 12*c* provided in the vicinity of the seal tube 12*b*.

The tail ring 12*a* is in contact with the inner circumferential surface of the skin plate 10 and movably provided along the axial direction (forward and backward direction in FIG. 1) of the skin plate 10, wherein for example, it is moved by an actuator such as a jack outside the drawing.

The seal tube 12*b* is composed of rubber which is hollow and is annularly provided on the entire circumference along the inner circumferential surface of the tail ring 12*a*, one end of which is secured and fixed at the inner circumferential surface of the tail ring 12*a*.

The seal tube 12*b* is connected to a compressor or an oil hydraulic power unit outside the drawing via a switching valve, and the seal tube 12*b* is enlarged in diameter by supplying compressed fluid such as compressed air or oil thereto, and concurrently, is reduced in diameter by discharging the compressed fluid therefrom.

The packing 12*c* is composed of a rubber plate, etc., and is annularly provided on the entire circumference along the inner circumferential surface of the tail ring 12*a*.

The packing 12*c* is such that only one end thereof is secured and fixed on the inner circumferential surface of the tail ring 12*a*, and the other end thereof is a free end, wherein the free end side is adhered to the outside of the seal tube 12*b*.

If the seal tube 12*b* is enlarged in diameter at the first tail seal 12 thus constructed, the free end side of the packing 12*c* is pushed inwardly in line with the enlargement, and the tip end side of the packing 12*c* is pressure-fitted to the outer circumferential surface of the segments 11.

Furthermore, if the seal tube is reduced in diameter, the free end side of the packing 12*c* is moved to the seal tube 12*b* side in line with the reduction, and the tip end of the packing 12*c* is spaced from the outer circumferential surface of the segments 11.

The second tail seal 14 is disposed rearward of the first tail seal 12 in the direction of excavation, and it is provided with a seal tube 14*a* secured and fixed on the inner circumferential surface of the skin plate 10, and packing 14*b*.

The seal tube 14*a* is annularly disposed so as to turn around along the inner surface of the skin plate 10 as well as the seal tube 12*a* of the first tail seal 12.

The seal tube 14*a* is connected to a compressor or an oil hydraulic power unit outside the drawing via a switching valve, wherein the seal tube 14*a* is enlarged in diameter by supplying compressed fluid such as compressed air or oil thereto, and is reduced in diameter by discharging the compressed fluid therefrom.

Packing 14*b* is composed of a rubber plate, etc., and is disposed so as to turn around along the inner surface of the skin plate 10.

The packing 14*b* is such that only one end side thereof is secured and fixed at the inner circumferential surface of the skin plate 10, and the other end side is made a free end, wherein the free end side is adhered to the outer surface of the seal tube 14*a*.

In the second tail seal 14 thus constructed, the free end side of the packing 14*b* is moved inwardly or outwardly, as in the first tail seal 12, in line with the enlargement or reduction of the seal tube 14*a* in diameter, and the tip end side of the packing 14*b* is pressure-fitted to the first tail seal 12 and the outer circumferential surface of the segments or spaced from the outer circumferential surface thereof.

The third tail seal 16 is composed of an annular tail brush, one end of which is secured and fixed on the inner surface at the rear end side of the skin plate 10 and is constructed so as to be slidably brought into contact with the outer circumferential surface of the segments 11.

Furthermore, the third tail seal 16 has the same functions as those of a general earth and sand seal, which prevents earth and sand, and back-filling material from flowing inwardly. Furthermore, the third tail seal 16 may be provided in multiple flutes.

Next, a description is given of actions of a tail structure constructed as described above. FIG. 1 through FIG. 7 show operating states of the tail structure when causing the shield driving machine to excavate or assembling the segments 11.

FIG. 1 shows a state before the shield driving machine begins excavating, wherein segments 11 equivalent to three rings are coupled, the first tail seal 12 is located at the end edge, in the direction of excavation, of the left side segments 11 assembled immediately before, and the second tail seal 14 is located right above the coupled portion of the middle segment 3.

Furthermore, the third tail seal 16 is slidably in contact with the outer circumferential surface of the right end segment 11. In this state before excavation, the seal tube 12*b* of the first tail seal 12 is enlarged in diameter and the packing 12*c* is pressure-fitted to the outer circumferential surface of the left end segment 11, whereby peripheral water is prevented from invading.

On the other hand, the second tail seal 14 and seal tube 14*a* are reduced in diameter, and the packing 14*b* is spaced upward from the outer circumferential surface of the segment 11.

As the excavation of the shield driving machine is commenced from the state shown in FIG. 1, the first tail seal 12 does not cause the tail ring 12*a* to move and leaves it as it is, wherein only the skin plate 10 is permitted to advance.

And until the excavation equivalent to one ring length corresponding to the axial length of the segments 11 is finished, the operating state of the first tail seal 12 and the second tail seal 14 are maintained as they are.

Figure 2:
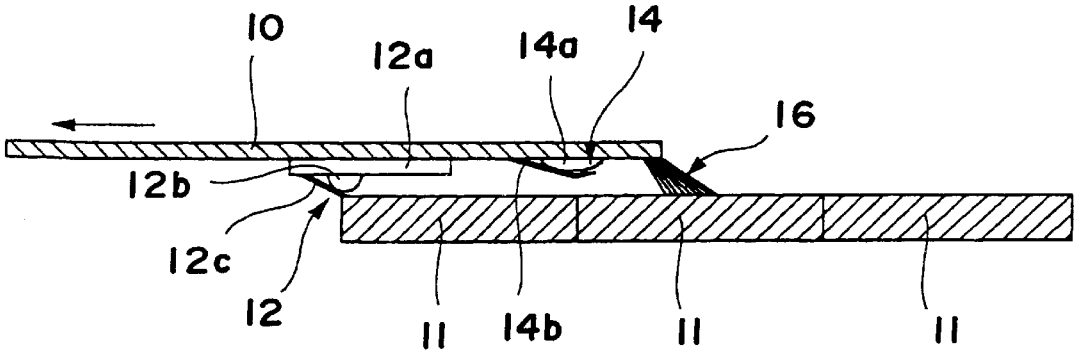
FIG. 2 is a sectional view showing a state where the shield driving machine is started for excavation from the state shown in FIG. 1.

At this time, the operating states of the first tail seal 12 and the second tail seal 14, and the mutual positional relationship are illustrated in FIG. 2, wherein in this state, the second tail seal 14 is drawn near the first tail seal 12 by only the distance equivalent to one ring.

Figure 3:
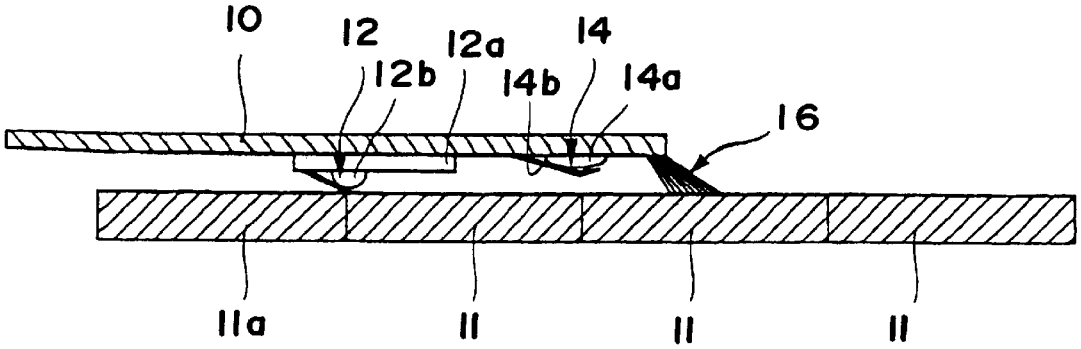
FIG. 3 is a sectional view showing a state where segments are assembled in the state illustrated in FIG. 2.

Next, as shown in FIG. 3, a new segment 11*a* is assembled at the left side of the third ring. Until the new segment 11*a* is assembled, the operating states of the first tail seal 12 and second tail seal 14 are maintained as described above.

Figure 4:
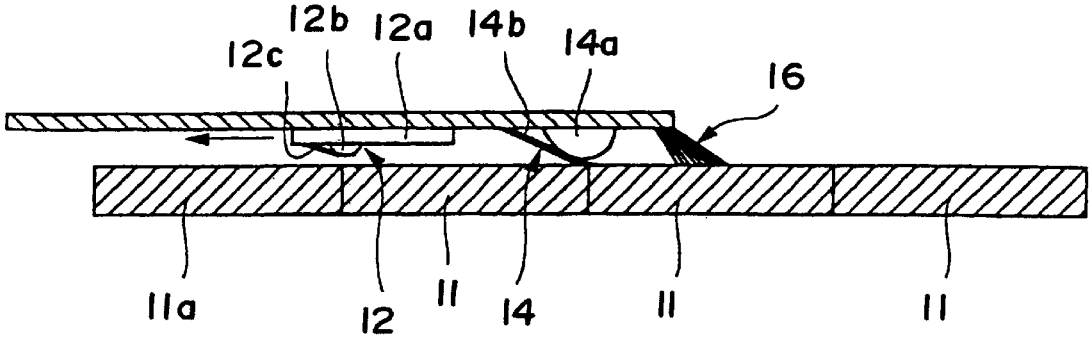
FIG. 4 is a sectional view showing a state before the first tail seal according to the invention is moved in the state illustrated in FIG. 3.

As the assembling and connection of the new segment 11*a* are completed, as shown in FIG. 4, first, the seal tube 14*a* of the second tail seal 14 is enlarged in diameter to cause the packing 14*b* to be pressure-fitted to the outer circumferential surface of the segments 11, wherein peripheral water is prevented from invading inwardly by operation of the second tail seal 14.

Next, the seal tube 12*b* of the first tail seal 12 is reduced in diameter, the packing 12*c* is caused to be spaced upward from the outer circumferential surface of the segments 11, and the tail ring 12*a* is moved forward by only the distance equivalent to one ring length.

Figure 5:
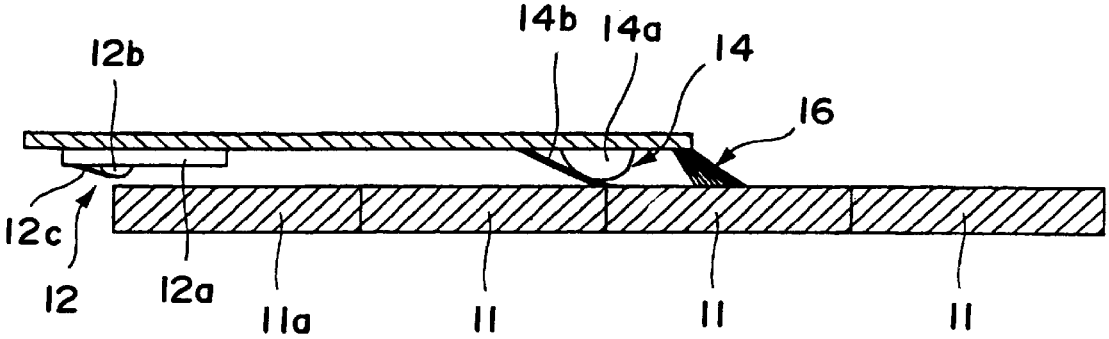
FIG. 5 is a sectional view showing a state where the first tail seal according to the invention is moved forward from the state illustrated in FIG. 4.

FIG. 5 shows a state where the abovementioned operation is completed. The seal tube 14*a* of the second tail seal 14 is maintained at its enlarged state until the movement of the tail ring 12*a* is completed, and the packing 14 is pressure-fitted to the outer circumferential surface of the segment 11, whereby peripheral water, etc. can be prevented from invading.

Figure 6:
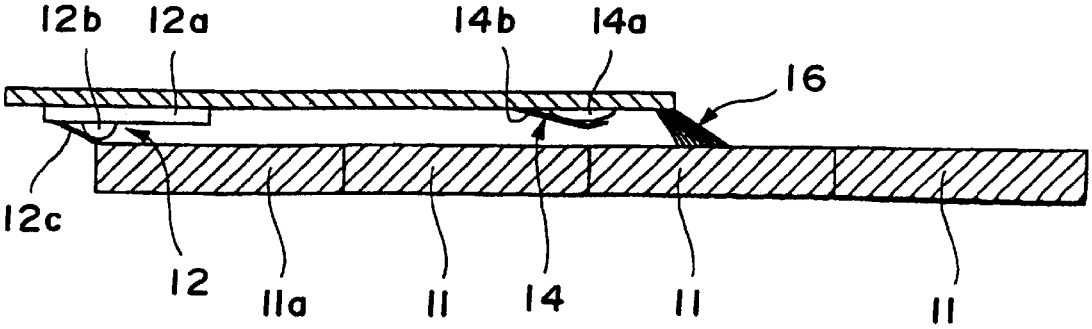
FIG. 6 is a sectional view showing a state before the shield driving machine is started for excavation from the state illustrated in FIG. 5.

Subsequently, as the movement of the tail ring 12*a* is completed, as shown in FIG. 6, the seal tube 12*b* of the first tail seal 12 is enlarged in diameter, the packing 12*c* is pressure-fitted to the outer circumferential surface of the segment 11*a*, and peripheral water is prevented from invading. Thereafter, the seal tube 14*a* of the second tail seal 14 is reduced in diameter, and the packing 14*b* is spaced from the outer circumferential surface of the segments 11. After that, operating states similar to those described above are repeated in line with advancement of the excavation by the shield driving machine.

Herein, according to the seal structure constructed as described above, since any one of the first tail seal 12 and the second tail seal 14 is always pressure-fitted to the outer circumferential surface of the segment 11 when causing the shield driving machine to excavate or assembling the segments, it is possible to prevent peripheral water, etc., from invading.

Furthermore, in the case of the preferred embodiment, since, when the shield driving machine is excavating, the first tail seal 12 is pressure-fitted to the outer circumferential surface of the segments 11 without moving the first tail seal 12, and concurrently, the second tail seal 14 is spaced from the outer circumferential surface of the segments 11, the first tail seal 12 and second tail seal 14 do not move slidably in contact with the segments 11 in line with the excavation by the shield driving machine, no friction is produced between the respective tail seals 12 and 14, and the segments 3, and the durability of the tail seals 12 and 14 is further improved, wherein that the number of times of replacement of tail seals 12 and 14 is reduced even in a long distance excavation.

Furthermore, in the case of the preferred embodiment, since the first tail seal 12 is disposed frontward of the second tail seal 14 in the direction of excavation, and the tail ring 12*a* is made movable, the seal tube 12*b* and packing 12*c* of the first tail seal 12 can be easily replaced by drawing them out toward the shield driving machine side.

FIG. 7 through FIG. 12 show another preferred embodiment of a tail structure of a shield driving machine according to the invention. The preferred embodiment illustrated in these drawings is an example which is applied to the building of a water-intake tunnel. The parts which are identical to those of the abovementioned embodiment are given the same reference numbers.

Figure 7:
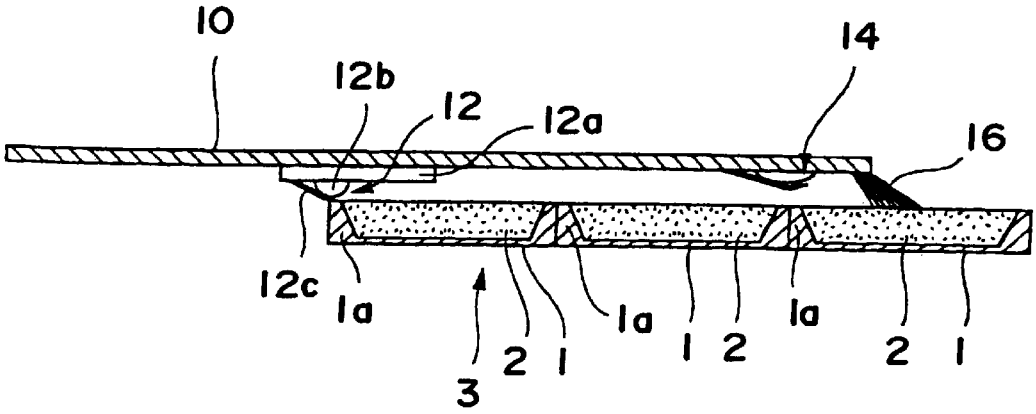
FIG. 7 is a sectional view showing a state before excavation by a shield driving machine, which shows another preferred embodiment of the tail structure of the shield driving machine according to the invention.

FIG. 7 is a sectional view of the tail portion of the shield driving machine. A skin plate 10 illustrated in the drawings is formed to be cylindrical in the shield driving machine. A water-intake segment 3 is as described in the Background section of this specification.

Similar to usual segments, water-intake segments are assembled to be annular at the tail portion side one after another in line with advancement of the excavation of the shield driving machine, and are such that a permeable member 2 is attached to the outside of the body plate 1 such as steel segments and ductile segments.

A water-intake opening (not illustrated), which is closed during construction of a water-intake tunnel and is opened after the tunnel is completed, is provided in the body plate 1 of each of the respective water-intake segments 3, and concurrently, one part of the body plate 1 is exposed to both ends of the permeable member 2, wherein the exposed portion forms a non-permeable portion 1*a*.

In the tail structure illustrated in FIG. 7, the first tail seal 12 and second tail seal 14 are provided along the axial direction of the skin plate 10 of the shield driving machine, and the third tail seal 16 is provided at the rear end of the skin plate 10.

The first tail seal 12 consists of an annular tail ring 12*a* along the inner circumferential surface of the skin plate 12 at the tail side, a seal tube 12*b* secured and fixed at the inner circumferential side of the tail ring 12*a*, and packing 12*c* provided in the vicinity of the seal tube 12*b*.

The tail ring 12*a* is made in contact with the inner circumferential surface of the skin plate 10 and is provided so as to be movable along the axial direction (forward and backward direction in FIG. 7) of the skin plate 10, wherein, for example, the tail ring 12*a* is moved by an actuator such as a jack outside the drawing.

The seal tube 12*b* is composed of rubber whose section is hollow, and is provided to be annular on the entire circumference along the inner circumferential surface of the tail ring 12*a*, one end of which is secured and fixed on the inner circumferential surface of the tail ring 12*a*.

The seal tube 12*b* is connected to a compressor or an oil hydraulic power unit outside the drawings, via a switching valve, and the seal ring 12*a* is enlarged in diameter by supplying compressed fluid such as compressed air or oil thereto, and is reduced in diameter by discharging the compressed fluid therefrom.

The packing 12*c* is composed of a rubber plate, etc., and is provided to be annular on the entirety of the circumference along the inner circumferential surface of the tail ring 12*a*.

The packing 12*c* is such that only one end thereof is secured and fixed on the inner circumferential surface of the tail ring 12*a*, and the other end thereof is made a free end, wherein the free end side is adhered to the outer surface of the seal tube 12*b*.

In the first tail seal 12 thus constructed, if the seal tube 12*b* is enlarged in diameter, the free end side of the packing 12*c* is pushed inwardly in line with the enlargement, and the tip end side of the packing 12*c* is pressure-fitted to the non-permeable portion 1*a* of the water-intake segments 3.

If the seal tube 12*b* is reduced in diameter, the free end side of the packing 12*c* is moved to the seal tube 12*b* side in line with the reduction, and the tip end side of the packing 12*c* is spaced from the non-permeable portion 1*a* of the water-intake segments 3.

The second tail seal 14 is disposed rearward of the first tail seal portion 12, and is provided with a seal tube 14*a* secured and fixed on the inner circumferential surface of the skin plate 10, and packing 14*b*.

The seal tube 14*a* is annularly disposed so as to turn around along the inner surface of the skin plate 10 as in the seal tube 12*a* of the first tail seal 12. The seal tube 14*a* is connected to a compressor or an oil hydraulic power unit outside the drawings, via a switching valve, wherein by supplying compressed fluid such as compressed air or oil thereto, the seal tube 14*a* is enlarged in diameter, and, by discharging the same therefrom, the seal tube 14*a* is reduced in diameter.

The packing 14*b* is composed of a rubber plate, etc., and is annularly disposed so as to turn around along the inner surface of the skin plate 10.

The packing 14*b* is such that only one end thereof is secured and fixed at the inner circumferential surface of the skin plate 10, and the other end thereof is made a free end, and the free end side is adhered to the outer surface of the seal tube 14*a*.

In the second tail seal 14 thus constructed, as in the first tail seal 12, if the seal tube 14*a* is enlarged in diameter, the free end side of the packing 14*b* is pushed inwardly in line with the enlargement thereof, and the tip end side of the packing 14*b* is pressure-fitted to the first tail seal 12 and the non-permeable portion 1*a* of another water-intake segment 3.

The third tail seal 16 is composed of an annular tail brush, one end of which is secured and fixed on the inner surface at the rear end side of the skin plate 10, and it is slidably brought into contact with the outer surface of the water-intake segment 3.

Furthermore, the third tail seal 16 functions, as well, as a general earth and sand seal, and it is able to prevent earth and sand, and a back-filling material from flowing thereinto.

Next, a description is given of actions of the tail structure according to the above construction. FIG. 7 through FIG. 12 show operating states of the tail structure when causing the shield driving machine to excavate and assembling water-intake segments 3.

FIG. 7 shows a state before the shield driving machine begins excavating. In this state, the water-intake segments 3 equivalent to three rings are connected to each other, the first tail seal 12 is located right above the non-permeable portion 1*a* of the left end side water-intake segment 3 assembled immediately before, and the second tail seal 14 is located right above the connection portion of the middle water-intake segment 3.

Furthermore, the third tail seal 16 is slidably brought into contact with the permeable member 2 of the right end water-intake segment 3. In the state before excavation, the seal tube 12*b* of the first tail seal 12 is enlarged in diameter, and the packing 12*c* is pressure-fitted to the non-permeable portion 1*a* of the left end water-intake segment 3, whereby it is possible to prevent peripheral water from invading.

On the other hand, the second tail seal 14 and seal tube 14*a* are reduced in diameter, and the packing 14*b* is spaced upward from the non-permeable portion 1*a* of the water-intake segment 3.

As the shield driving machine begins excavating from the state shown in FIG. 7, the first tail seal 12 does not cause the tail ring 12*a* to move and leaves it as it is, wherein only the skin plate 10 is permitted to advance.

Figure 8:
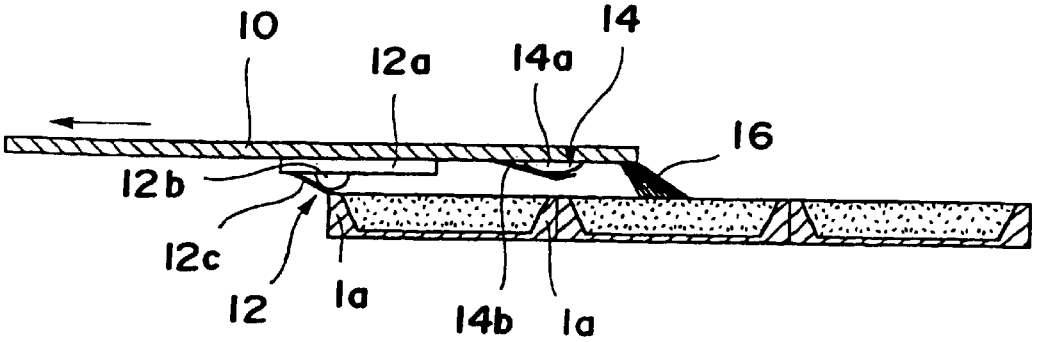
FIG. 8 is a sectional view showing a state where the shield driving machine is started for excavation from the state illustrated in FIG. 7.

Subsequently, the operating states of the first tail seal 12 and second tail seal 14 remain unchanged until the excavation equivalent to one ring corresponding to the axial length of the water-intake segment 3 is finished. FIG. 8 shows the operating states of the first tail seal 12 and second tail seal 14 at this time and the mutual positional relationship therebetween. In this state, the second tail seal 14 is drawn near to the first tail seal 12 by only the distance equivalent to one ring.

Figure 9:
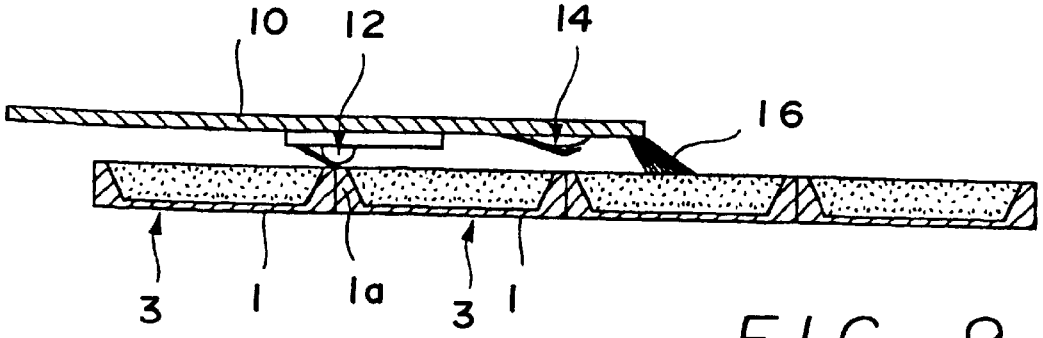
FIG. 9 is a sectional view showing a state where water-intake segments are assembled in the state illustrated in FIG. 8.

Next, as shown in FIG. 9, a new water-intake segment 3 is assembled at the left side of the third ring. The operating states of the first and second tail seals 12 and 14 are maintained as in the state described above until the newly secured water-intake segment 3 is completely assembled.

Figure 10:
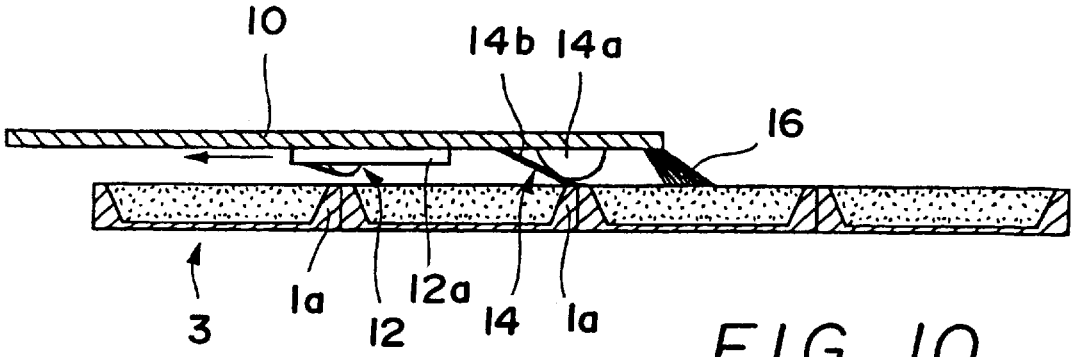
FIG. 10 is a sectional view showing a state before the first tail seal according to the invention is moved forward in the state illustrated in FIG. 9.

As the assembling and connection of the newly secured water-intake segment 3 are completed, as shown in FIG. 10, first, the seal tube 14*a* of the second tail seal 14 is enlarged in diameter, the packing 14*b* is pressure-fitted to the non-permeable portion 1*a* of the water-intake segment 3, and peripheral water is able to be prevented from invading by operation of the second tail seal 14.

Next, the seal tube 12*b* of the first tail seal 12 is reduced in diameter, and the packing 12*c* is spaced upward from the non-permeable portion 1*a,* wherein the tail ring 12*a* is moved forward by only a distance equivalent to one ring.

Figure 11:
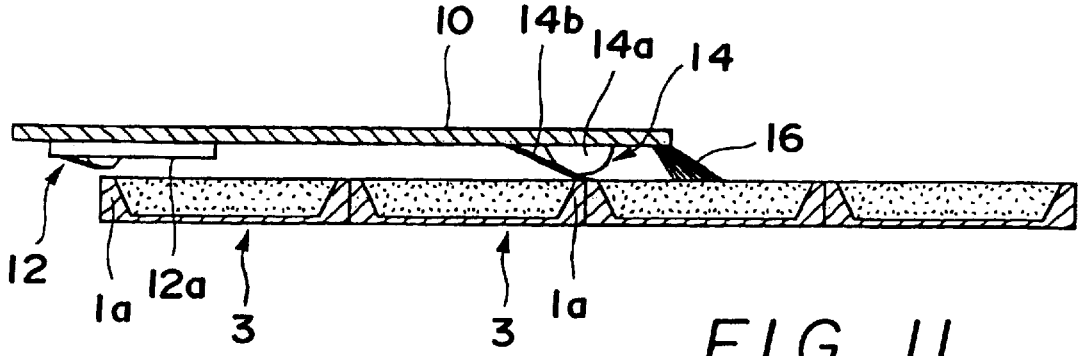
FIG. 11 is a sectional view showing a state after the first tail seal according to the invention is moved forward from the state illustrated in FIG. 10.
Figure 12:
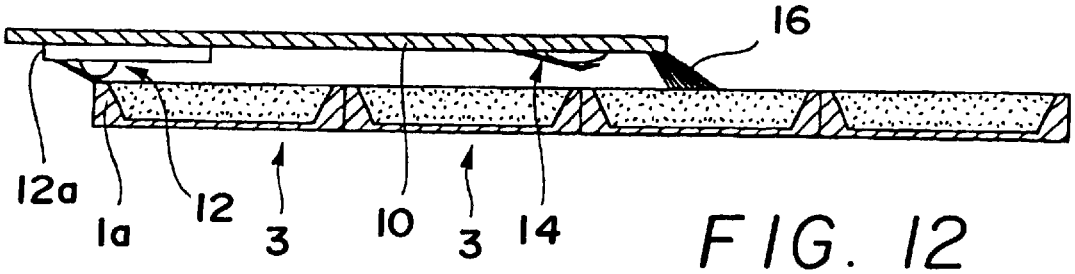
FIG. 12 is a sectional view showing a state where the shield driving machine is started for excavation from the state illustrated in FIG. 11.
Figure 13:
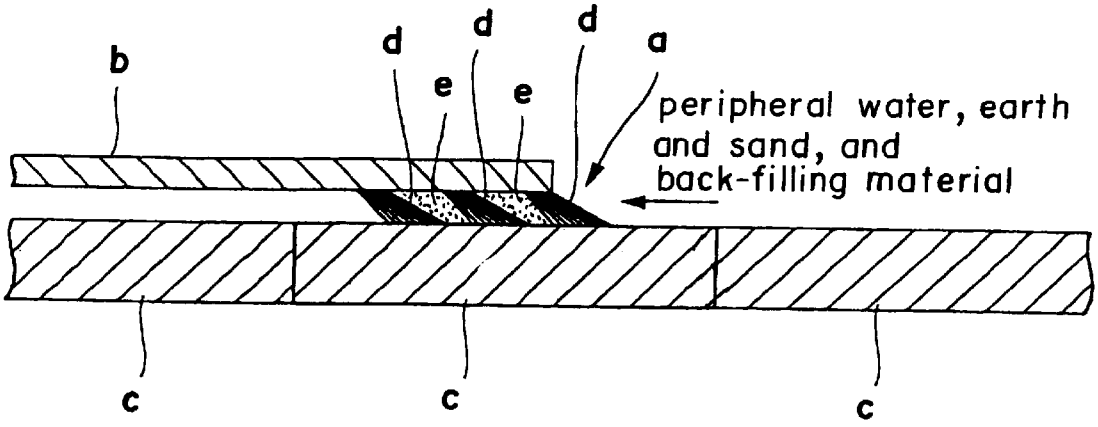
FIG. 13 (PRIOR ART)
FIG. 13 is a sectional view showing one example of a tail structure of a conventional shield driving machine.
Figure 14:
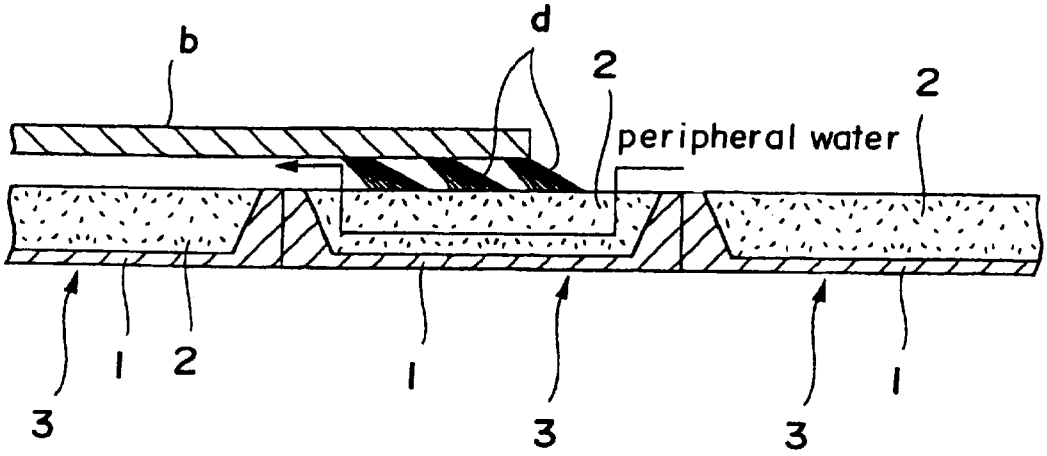
FIG. 14 is a explanatory view showing a case where the tail structure illustrated in FIG. 7 is applied to water-intake segments.

FIG. 11 shows the state where the movement is completed. The seal tube 14*a* of the second tail seal 14 is maintained in its enlarged state until the movement of the tail ring 12*a* is completed, and the packing 14*b* is pressure-fitted to the non-permeable portion 1*a,* whereby peripheral water can be prevented from invading.

And as the movement of the tail ring 12*a* is completed, the seal tube 12*b* of the first tail seal 12 is enlarged in diameter, and the packing 12*c* is pressure-fitted to the non-permeable portion 1*a* of the water-intake segment 3, wherein after preventing the peripheral water from invading, the seal tube 14*a* of the second tail seal 14 is reduced in diameter, and the packing 14*b* is spaced from the non-permeable portion 1*a*. Thereafter, operations similar thereto are repeated in line with excavation of the shield driving machine.

According to the seal structure constructed as described above, since either one of the first tail seal 12 and second tail seal 14 is always pressure-fitted to the non-permeable portion 1*a* of the water-intake segment 3 when causing the shield driving machine to excavate or assembling the water-intake segments, it is possible to prevent peripheral water from invading.

Furthermore, in the case of the preferred embodiment, since the first tail seal 12 is pressure-fitted to the non-permeable portion 1*a* without moving the first tail seal 12, and concurrently, the second tail seal 14 is spaced from the non-permeable portion 1*a*, the first and second tail seals 12 and 14 do not move while slidably being brought into contact with the water-intake segment 3 in line with the excavation of the shield driving machine, wherein no friction is produced between the respective tail seals 12 and 14, and the segment 3, the durability of the tail seals 12 and 14 is further improved, and it is possible to reduce the number of times of replacing the tail seals 12 and 14 in a long distance excavation.

Furthermore, in the case of the preferred embodiment, since the tail ring 12*a* is made movable, it is possible to easily replace the seal tube 12*b* and packing of the first tail seal 12 by drawing out the tail ring 12*a* to the shield driving machine side.

Furthermore, although, in the abovementioned preferred embodiment, a description is given of a case where one seal tube 12*b* and packing 12*c* are disposed at the tail ring 12*a* of the first tail seal 12, the present invention is not limited to the abovementioned case, for example, a plurality of seal tubes 12*b* and packing 12*c* may be disposed at the tail ring 12*c,* and they may be operated at the same time.

What is claimed is:

1. A tail sealing structure for a shield driving machine disposed between an outer circumferential surface of segments installed on an excavation wall surface and an inner circumferential surface of a skin plate at a tail side of said driving machine for preventing peripheral water, earth and sand, and backfilling material from flowing between the skin plate and segments, comprising:

a first tail seal and a second tail seal axially spaced apart in the axial direction of said skin plate, each of said seals being selectively expandible into sealing contact with said segments; and said first tail seal being movable in the axial direction of said skin plate, and said second tail seal being fixed on said skin plate.

2. A tail sealing structure of a shield driving machine as set forth in claim 1, wherein said first tail seal is disposed in front of said second tail seal in a direction of excavation; and wherein said first tail seal includes:

a tail ring movably mountable along the axial direction of said skin plate;

a seal tube secured and fixed at said tail ring having a diameter of which is enlargeable and reduceable; and packing which is sealingly engageable against said segments when said seal tube diameter is enlarged.

3. A tail sealing structure of a shield driving machine disposed between an outer circumferential surface of water-intake segments secured on an excavation wall surface and an inner circumferential surface of a skin plate of said shield driving machine at a tail side for preventing inflow of peripheral water between said skin plate and said segments, comprising a first tail seal and a second tail seal axially spaced apart on said skin plate, each of which is selectively sealingly engageable against said circumferential surface of said water-intake segments such that one any one of said first and second tail seals is always sealingly engaged to a non-permeable portion of said water-intake segments when said shield driving machine is excavating or said water-intake segments are assembled.

4. A tail sealing structure of a shield driving machine as set forth in claim 3, wherein said first tail seal is movably mountable along the axial direction of said skin plate, and said second tail seal is affixed to said skin plate.

5. A tail sealing structure of a shield driving machine as set forth in claim 4, wherein said first tail seal is provided with:

a tail ring movably mountable along the axial direction of said skin plate;

a seal tube secured and fixed at said tail ring having a diameter of which is enlargeable and reduceable; and packing which is in contact with said tube and sealingly engageable against said non-permeable portion when said seal tube is enlarged.

6. A tail sealing structure of a shield driving machine as set forth in claim 3, wherein said water-intake segment is assembled onto a tail side of said shield driving machine.

7. A tail sealing structure of a shield driving machine as set forth in claim 6, wherein said water-intake segment has a non-permeable body plate secured at a water intake opening which is able to be opened and closed, and a permeable member integrated with the outside of said body plate.

* * * * *